US007973493B2

(12) United States Patent
Onishi et al.

(10) Patent No.: US 7,973,493 B2
(45) Date of Patent: Jul. 5, 2011

(54) DISCHARGE LAMP LIGHTING DEVICE, AND ILLUMINATING DEVICE

(75) Inventors: Naoki Onishi, Kobe (JP); Tetsuya Hamana, Amagasaki (JP); Keisuke Ueda, Hirakata (JP); Kouichi Ikegami, Himeji (JP); Kazuhiko Tachibana, Kakogawa (JP); Takuya Sakai, Himeji (JP)

(73) Assignees: Panasonic Electric Works Co., Ltd., Osaka (JP); Ikeda Electric Co., Ltd., Hyogo (JP)

( * ) Notice: Subject to any disclaimer, the term of this patent is extended or adjusted under 35 U.S.C. 154(b) by 346 days.

(21) Appl. No.: 12/439,083

(22) PCT Filed: Aug. 27, 2007

(86) PCT No.: PCT/JP2007/066560

§ 371 (c)(1),
(2), (4) Date: Feb. 26, 2009

(87) PCT Pub. No.: WO2008/029655

PCT Pub. Date: Mar. 13, 2008

(65) Prior Publication Data

US 2010/0013393 A1 Jan. 21, 2010

(30) Foreign Application Priority Data

Aug. 31, 2006 (JP) ..... 2006-236533

(51) Int. Cl.
*G05F 1/00* (2006.01)

(52) U.S. Cl. ..... 315/291; 315/224; 315/307; 315/247; 315/209 R

(58) Field of Classification Search ..... 315/291, 315/297, 307–311, 224, 225, 247, 274, 276–279
See application file for complete search history.

(56) References Cited

U.S. PATENT DOCUMENTS 5,066,894 A 11/1991 Klier (Continued)

FOREIGN PATENT DOCUMENTS

EP 0422255 4/1991

(Continued)

OTHER PUBLICATIONS

English language Abstract of JP 2005-50652, Feb. 24, 2005.

(Continued)

*Primary Examiner* — Tuyet Thi Vo

(74) *Attorney, Agent, or Firm* — Greenblum & Bernstein, P.L.C.

(57) ABSTRACT

In order to enhance stability of a discharge lamp at the time of dimming lighting even in the case where a light output is lowered, a direct current superimposing circuit superimposes a direct current voltage on an alternating current voltage applied to a fluorescent lamp, and a dimming signal correction circuit receives a detection value of a direct current voltage detection circuit and a dimming signal that is from an outside, outputs a dimming signal higher in level than the dimming signal in the case where the detection value of the direct current voltage detection circuit exceeds a first threshold value, and decreases the level of the outputted dimming signal to the level of the inputted dimming signal in the case where the detection value of the direct current voltage detection circuit falls down below a second threshold value that is equal to or less than the first threshold value. Then, an amount of alternating current power supplied to the fluorescent lamp by an inverter circuit is increased and decreased in response to fluctuations of the level of the dimming signal outputted by the dimming signal correction circuit, whereby the fluorescent lamp is dimmed.

10 Claims, 10 Drawing Sheets

U.S. PATENT DOCUMENTS

| | | | |
|---|---|---|---|
| 2005/0023995 | A1 | 2/2005 | Ohnishi et al. |
| 2007/0210727 | A1 | 9/2007 | Sun et al. |
| 2008/0030143 | A1 | 2/2008 | Goriki et al. |
| 2008/0048586 | A1 | 2/2008 | Hasegawa et al. |
| 2008/0143270 | A1 | 6/2008 | Sun et al. |
| 2008/0157693 | A1 | 7/2008 | Yamamoto et al. |

FOREIGN PATENT DOCUMENTS

| | | |
|---|---|---|
| JP | 2002-75681 | 3/2002 |
| JP | 2003-7493 | 1/2003 |
| JP | 2005-50649 | 2/2005 |
| JP | 2005-50652 | 2/2005 |
| JP | 2005-259454 | 9/2005 |
| JP | 2006-107783 | 4/2006 |
| WO | 2006/111269 | 10/2006 |

OTHER PUBLICATIONS

English language Abstract of JP 2003-7493, Jan. 10, 2003.
English language Abstract of JP 2006-107783, Apr. 20, 2006.
English language Abstract of JP 2005-50649, Feb. 24, 2005.
English language Abstract of JP 2005-259454, Sep. 22, 2005.
English language Abstract of JP 2002-75681, Mar. 15, 2002.
U.S. Appl. No. 12/438,582 to Fukuda et al., which was filed on Feb. 24, 2009.
U.S. Appl. No. 12/438,583 to Matsuzaki et al., which was filed on Feb. 24, 2009.
Extended European Search report from E.P.O., dated Mar. 21, 2011.

DISCHARGE LAMP LIGHTING DEVICE, AND ILLUMINATING DEVICE

TECHNICAL FIELD

The present invention relates to a discharge lamp lighting device, and to an illuminating device.

BACKGROUND ART

As a discharge lamp lighting device that lights a discharge lamp of which representative is a fluorescent lamp, a general one is an electronic ballast that lights the discharge lamp at a high frequency by using an inverter circuit that converts a commercial alternating current voltage into a direct current voltage and converts this direct current voltage into a high frequency voltage. As such an electronic ballast, there is one that has a dimming function capable of changing brightness of the discharge lamp by increasing or decreasing an amount of supplied power to the discharge lamp in response to fluctuations of a dimming signal inputted to the electronic ballast concerned from the outside. The electronic ballast added with this dimming function is generally used for saving energy, and for a stage direction. The discharge lamp lighting device added with the dimming function, which is as described above, is required to have stable dimming performance that does not allow occurrences of unstable phenomena such as variations and flicker of a light output, for example, up to a low-luminous-flux dimming range such as 10% or less of a rating light output.

As the discharge lamp lighting device, there is known one that, in order to respond to such a requirement, detects a lighting state of the discharge lamp, and performs feedback control so that the output of the discharge lamp can become a predetermined output in response to the inputted dimming signal. For this feedback control, there are generally used: a method in which a lamp current flowing through the discharge lamp is detected, and the feedback control is performed so that a value of the detected lamp current can become a predetermined current value corresponding to the dimming signal; and a method in which the lamp power supplied to the discharge lamp is detected, and the feedback control is performed so that a value of the detected power can become a predetermined power value corresponding to the dimming signal.

FIG. 11 is a circuit diagram showing a representative configuration of a conventional discharge lamp lighting device. In general, a direct current voltage source E1 can be easily composed of a configuration of rectifying a commercial power supply by a full-wave rectification circuit and thereafter smoothing the rectified commercial power supply by a capacitor, or of an AC/DC conversion circuit such as a step-up chopper circuit. The direct current voltage source E1 generates a direct current voltage Vdc.

In this discharge lamp lighting device, between a positive electrode and negative electrode of the direct current voltage source E1, a series circuit having a high-side switching element Q1, a low-side switching element Q2 and a resistor R1 is connected. This discharge lamp lighting device composes a half-bridge inverter circuit INV (alternating current output circuit) that converts the direct current voltage Vdc into a high-frequency voltage by alternately switching the switching elements Q1 and Q2 at a high frequency.

Moreover, in the discharge lamp lighting device, both ends of a series circuit of the switching element Q2 and the resistor R1 compose output ends of the inverter circuit INV. Between these output ends, a series circuit of an inductor L1 and a capacitor C1 is connected, further, between both ends of the capacitor C1, a series circuit of a capacitor C2 and a fluorescent lamp (discharge lamp) FL is connected, and a resonance circuit is composed of the inductor L1 and the capacitors C1 and C2. The discharge lamp lighting device applies a substantially sinusoidal high-frequency voltage to the fluorescent lamp FL, and thereby lights the fluorescent lamp FL at a high frequency.

Between the output ends of the inverter circuit INV, a series circuit of a primary winding of a transformer T1 and a capacitor C3 for cutting the direct current is further connected. To both ends a and b and both ends c and d of two sets of secondary windings of the transformer T1, both ends of respective filaments of the fluorescent lamp FL are connected through capacitors C4 and C5, respectively. Preheating currents for appropriately heating the respective filaments of the fluorescent lamp FL are supplied thereto from the transformer T1.

Moreover, the resistor R1 connected in series to the switching element Q2 detects currents flowing through the switching element Q2, and equivalently detects an average of powers outputted from the inverter circuit INV based on an average value of the detected currents. Such average power of the inverter circuit INV, which is detected by the resistor R1, is inputted to an inverting input terminal of an operational amplifier OP1 through a resistor R2. To a non-inverting input terminal of the operational amplifier OP1, a dimming command value voltage Va10 outputted from a dimming command value control circuit 5 in response to a level of a dimming signal Vs1 inputted thereto from the outside is inputted. In the operational amplifier OP1, a capacitor C6 is connected between the inverting input terminal thereof and an output terminal thereof, and the operational amplifier OP1 compares these two inputs with each other, and changes an output voltage representing a difference therebetween.

To the output terminal of the operational amplifier OP1, an inverter control circuit 6 is connected. The inverter control circuit 6 changes switching frequencies of the switching elements Q1 and Q2 in response to the output voltage of the operational amplifier OP1. In such a way, the inverter control circuit 6 controls output power of the inverter circuit INV, and performs feedback control so that a both-end voltage of the resistor R1, which is equivalent to the output power of the inverter circuit INV, can become substantially the same as the dimming command value voltage Va10. Moreover, the dimming command value control circuit 5 appropriately changes the dimming command value voltage Va10 in response to the level of the dimming signal Vs1, thereby adjust the output power of the inverter circuit INV in response to the dimming signal Vs1, and dims the fluorescent lamp FL.

Moreover, a series circuit of resistors R12 and R13 connected between one end of the fluorescent lamp FL and a low-voltage-side output (ground level) of the direct current voltage source E1, and a capacitor C12 connected in parallel to the resistor R13, compose a direct current voltage detection circuit 2. This direct current voltage detection circuit 2 performs voltage division for a both-end voltage of the fluorescent lamp FL by the resistors R12 and R13, and smoothes the both-end voltage concerned by the capacitor C12, thereby detects a direct current voltage component of the high-frequency voltage generated on both ends of the fluorescent lamp FL. Moreover, an increase of the direct current voltage component owing to a rectification function (asymmetry of lamp current owing to half-wave discharge) of the fluorescent lamp FL at the time of an end of a lifetime of the fluorescent lamp FL is detected by a comparator circuit 20. In the case where the direct current voltage component reaches a predetermined value, an oscillation stop signal Vr10 is outputted from the comparator circuit 20 to the inverter control circuit 6, and the inverter control circuit 6 stops switching operations of the switching elements Q1 and Q2, and thereby prevents an occurrence of excessive stresses to the fluorescent lamp FL and such circuit parts at the time of the end of the lifetime.

Moreover, there is also a discharge lamp lighting device that makes feedback of the lighting state of the discharge lamp and gives a direct current bias to the discharge lamp in order to prevent fading of the discharge lamp at the time of low-luminous-flux dimming thereof (for example, Japanese Patent Laid-Open Publication No. 2002-75681).

As described above, in the general discharge lamp lighting device that detects the lamp current flowing through the discharge lamp and the lamp power supplied to the discharge lamp and performs the feedback control for the power supplied to the discharge lamp, the lamp current and the lamp power are lowered as a dimming ratio is lowered (light output is lowered). Therefore, for example, in such a low-luminous-flux dimming range where the dimming ratio is 10% or less of the rating light output, detection values of the lamp current and the lamp power become micro values, and accuracy of the feedback control is deteriorated. Therefore, in particular, in the case where the ambient temperature of the discharge lamp is low, there have been problems that it becomes difficult to maintain the lighting state of the discharge lamp, whereby the fading occurs, as well as that the light output of the discharge lamp is lowered, whereby the flicker is prone to occur.

The present invention has been made in consideration for the above-described circumstances. It is an object of the present invention to provide a discharge lamp lighting device capable of enhancing stability of the discharge lamp at the time of dimming lighting even in the case where the light output is lowered, and to provide an illuminating device.

DISCLOSURE OF THE INVENTION

The present invention is a discharge lamp lighting device that dims a discharge lamp by increasing or decreasing an amount of supplied power to the discharge lamp in response to fluctuations of a level of a dimming signal, including: an alternating current output circuit that supplies alternating current power to the discharge lamp; a direct current superimposing circuit that superimposes a direct current voltage on an alternating current voltage applied to the discharge lamp; a direct current voltage detection circuit that detects a direct current voltage component of a voltage generated on both ends of the discharge lamp; a dimming signal correction circuit that receives a detection value of the direct current voltage detection circuit and a dimming signal that is from an outside, outputs a dimming signal higher in level than the inputted dimming signal in a case where the detection value of the direct current voltage detection circuit exceeds a first threshold value, and decreases the level of the outputted dimming signal to the level of the inputted dimming signal in a case where the detection value of the direct current voltage detection circuit falls down below a second threshold value that is equal to or less than the first threshold value; and a control circuit that dims the discharge lamp by increasing or decreasing an amount of the alternating current power in response to fluctuations of the level of the dimming signal outputted by the dimming signal correction circuit, the alternating current power being supplied to the discharge lamp by the alternating current output circuit.

In accordance with this invention, in the discharge lamp lighting device, for example, even in the case where the ambient temperature becomes low and the light output of the discharge lamp is lowered, the dimming signal is corrected so as to suppress the decrease of the light output. Accordingly, the flicker and the fading are prevented from occurring owing to the decrease of the light output, and the stability of the discharge lamp at the time of the dimming lighting can be enhanced.

Moreover, in the present invention, it is desirable that the dimming signal correction circuit include: correction means for creating a dimming signal of which level increases in the case where the detection value of the direct current voltage detection circuit exceeds the first threshold value, and decreases in the case where the detection value of the direct current voltage detection circuit falls down below the second threshold value; and higher value prioritizing means for comparing the level of the dimming signal inputted from the outside and the level of the dimming signal outputted from the correcting means with each other, and outputting the dimming signal set at a higher one between the levels, and that the control circuit dim the discharge lamp by increasing or decreasing the amount of alternating current power in response to fluctuations of the level of the dimming signal outputted by the higher value prioritizing means, the alternating current power being supplied to the discharge lamp by the alternating current output circuit.

In accordance with this invention, a function of the dimming signal correction circuit can be realized.

Furthermore, in the present invention, it is desirable that the direct current superimposing circuit be composed in such a manner that the discharge lamp is connected through an impedance element to between both ends of a voltage source containing at least the direct current voltage component.

In accordance with this invention, a function of the direct current superimposing circuit can be realized.

Furthermore, in the present invention, it is desirable that a time constant at which the level of the dimming signal outputted by the dimming signal correction circuit is changed be set larger than a time constant at which the level of the dimming signal inputted to the dimming signal correction circuit is changed, and set smaller than a time constant at which the direct current voltage detection circuit detects the direct current voltage component.

In accordance with this invention, even in the case where the level of the dimming signal inputted from the outside radically changes, a transient change of the dimming signal outputted from the dimming signal correction circuit can be stabilized, and transient operations of the dimming signal correction circuit are stabilized.

Still further, it is desirable that the discharge lamp lighting device of the present invention further include: means for stopping the supply of the alternating current power from the alternating current output circuit to the discharge lamp in the case where the detection value of the direct current voltage detection circuit exceeds the first threshold value when the dimming signal outputted by the dimming signal correction circuit is at a predetermined level or more.

In accordance with this invention, excessive stresses to the discharge lamp and circuit parts at the time of a lifetime end of the discharge lamp can be prevented from occurring.

Still further, it is desirable that the discharge lamp lighting device of the present invention further include: an alternating current voltage detection circuit that detects an alternating current voltage component of the voltage generated on both ends of the discharge lamp; and means for stopping the supply of the alternating current power from the alternating current output circuit to the discharge lamp in a case where a detection value of the alternating current voltage detection circuit exceeds a third threshold value.

In accordance with this invention, the excessive stresses to the discharge lamp and the circuit parts can be prevented from occurring owing to lamp abnormality.

Still further, in the present invention, it is desirable that at least one threshold value among the first threshold value, the second threshold value and the third threshold value be made variable in response to the level of the dimming signal.

In accordance with this invention, the threshold value can be set at the optimum value corresponding to the level of the dimming signal, and such correction operations for the dimming signal, detection accuracy of a lifetime end state of the discharge lamp, detection accuracy of a lamp abnormal state, and the like can be enhanced.

Still further, in the present invention, it is desirable that the alternating current output circuit supply alternating current powers to a plurality of discharge lamps, and include a plurality of direct current voltage detection circuits which individually detect direct current voltage components of voltages generated on both ends of the respective discharge lamps, and that the dimming signal correction circuit correct the dimming signal in response to a detection value highest in level among detection values of the plurality of direct current voltage detection circuits.

In accordance with this invention, even if a difference occurs between the light outputs of the respective discharge lamps owing to variations of the circuit parts and the discharge lamps, the correction operations for the dimming signal level are performed in response to a state of the discharge lamp lower in light output. Accordingly, even in the case where the plurality of discharge lamps are provided, any one of the discharge lamps is prevented from causing the flicker and the fading as a result of that the light output thereof is lowered to an extreme.

Still further, the discharge lamp lighting device of the present invention may be composed by providing a microcomputer including: an input port to which the detection value of the direct current voltage detection circuit and the dimming signal that is from the outside are at least inputted; arithmetic operation means for executing a program, thereby outputting the dimming signal higher in level than the inputted dimming signal in the case where the detection value of the direct current voltage detection circuit exceeds the first threshold value, and decreasing the level of the outputted dimming signal to the level of the inputted dimming signal in the case where the detection value of the direct current voltage detection circuit falls down below the second threshold value; and an output port that outputs a dimming command value corresponding to the level of the dimming signal outputted by the arithmetic operation means.

In accordance with this invention, the respective functions can be realized by using the relatively inexpensive microcomputer, and accordingly, it becomes possible to reduce cost and to reduce a packaging space. Moreover, even in the case where a type of the discharge lamp to be lighted differs, it becomes possible to change the threshold values and the like by changing the program, and a design change can be performed easily.

Still further, the present invention is also applied to an illuminating device, including: a discharge lamp; the discharge lamp lighting device according to any one of claims 1 to 9, the discharge lamp lighting device lighting the discharge lamp; a housing that houses the discharge lamp lighting device; and sockets which connect the discharge lamp to the discharge lamp lighting device.

In accordance with this invention, in the illuminating device including the discharge lamp, for example, even in the case where the ambient temperature becomes low and the light output of the discharge lamp is lowered, the dimming signal is corrected so as to suppress the decrease of the light output. Accordingly, the flicker and the fading are prevented from occurring owing to the decrease of the light output, and the stability of the discharge lamp at the time of the dimming lighting can be enhanced.

BEST MODE FOR CARRYING OUT THE INVENTION

A description will be made below of embodiments of the present invention based on the drawings.

First Embodiment

Figure 1:
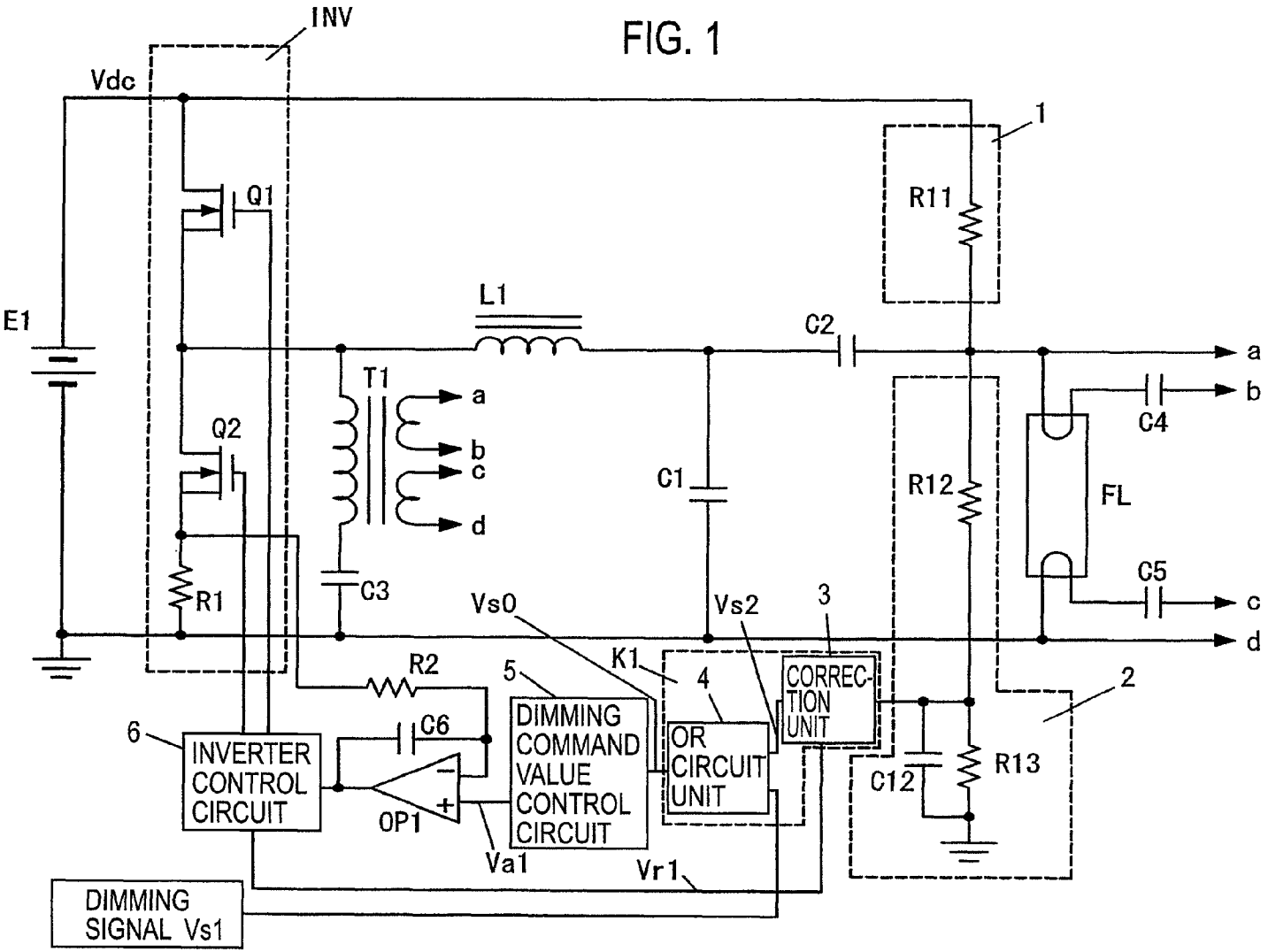
FIG. 1 is a diagram showing a circuit configuration of a discharge lamp lighting device of a first embodiment.
Figure 11:
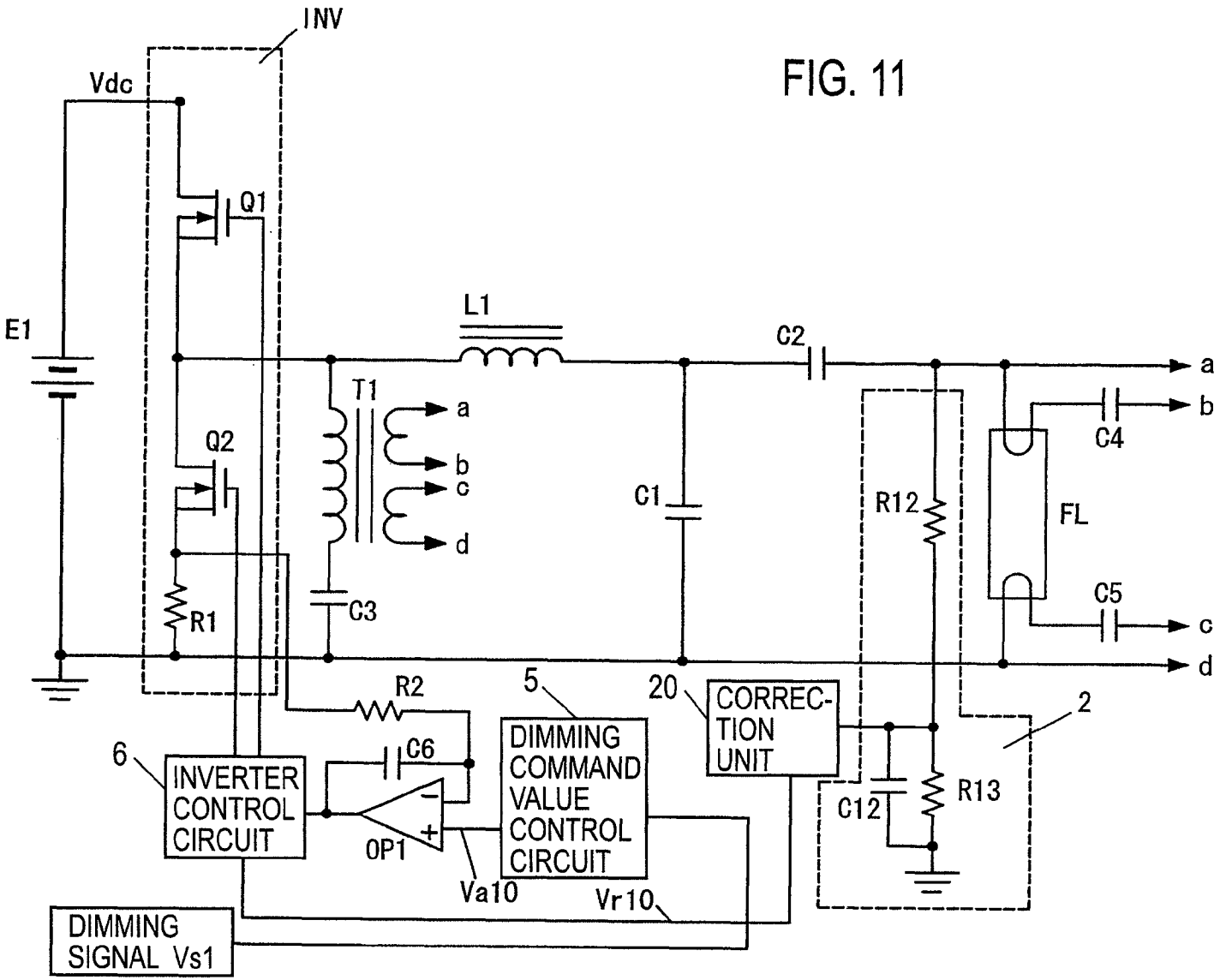
FIG. 11 is a diagram showing a circuit configuration of a conventional discharge lamp lighting device.

FIG. 1 is a circuit diagram showing a configuration of a discharge lamp lighting device of a first embodiment. In a conventional configuration shown in FIG. 11, the discharge lamp lighting device of the first embodiment includes: a direct current superimposing circuit 1 that superimposes a micro direct current voltage component on the high-frequency alternating current voltage applied from the inverter circuit INV to the fluorescent lamp FL in such a manner that a high-voltage-side output of the direct current voltage source E1 is connected to a node between the fluorescent lamp FL and the capacitor C2 through a resistor R11 serving as an impedance element; and a dimming signal correction circuit K1 that corrects the dimming signal based on the direct current voltage component of the fluorescent lamp FL, which is detected by the direct current voltage detection circuit 2, in which an output of the dimming signal correction circuit K1 is outputted to the dimming command value control circuit 5. Other configurations are similar to the conventional configurations shown in FIG. 11, and the same reference numerals are assigned to similar constituents, whereby a description thereof will be omitted.

Lighting and preheating operations for the fluorescent lamp FL by a high-frequency output of the inverter circuit INV, which is generated by this discharge lamp lighting device, are substantially similar to those of the conventional configuration, and a description will be made below of a dimming operation of the discharge lamp lighting device according to the first embodiment.

The dimming signal correction circuit K1 is composed of a correction unit 3 (correcting means) and an OR circuit unit 4 (higher value prioritizing means). The correction unit 3 has functions to compare a detection value of the direct current voltage detection circuit 2 with a first threshold value Vth1 and a second threshold value Vth2 (relationship of Vth1≧Vth2 is satisfied), and to output a dimming signal Vs2 with a level corresponding to a result of such comparison. In the case where the detection value of the direct current voltage detection circuit 2 exceeds the first threshold value Vth1, the level of the dimming signal Vs2 is increased by the correction unit 3, and in the case where the detection value of the direct current voltage detection circuit 2 falls down below the second threshold value Vth2, the level of the dimming signal Vs2 is decreased by the correction unit 3. Moreover, the OR circuit unit 4 compares the level of the dimming signal Vs1 inputted thereto from the outside and the level of the dimming signal Vs2 outputted from the correction unit 3 with each other, and outputs either of the dimming signals, of which level is higher.

Figure 2:
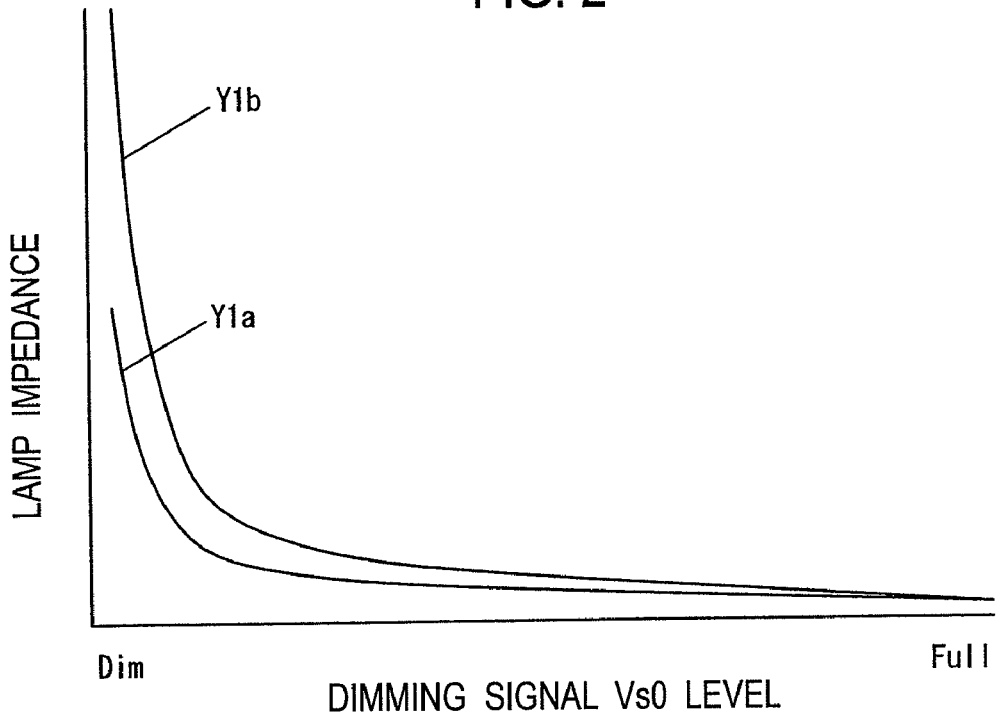
FIG. 2 is a chart showing characteristics of lamp impedances.

Here, FIG. 2 illustrates changes of lamp impedances, which follow the dimming of the fluorescent lamp FL. Characteristics Y1*a* represent lamp impedance characteristics at the time of room temperature, and characteristics Y1*b* represent lamp impedance at the time of low temperature. In general, when the dimming ratio is lowered, the discharge lamp represented by the fluorescent lamp FL exhibits characteristics of negative resistance in which equivalent impedance of the lamp is increased as a lamp current is decreased. As shown in FIG. 2, lamp impedance in which a level of a dimming signal Vs0 is at around rating lighting (Full) is relatively low, and for example, in the case of a straight tube-type fluorescent lamp of FHF32, this fluorescent lamp exhibits lamp impedance of approximately 300Ω. However, when the level of the dimming signal Vs0 is at around a dimming lower limit (Dim), the lamp impedance radically increases, and when the dimming ratio with respect to a rating output is approximately 5%, the lamp impedance increases to approximately 10 kΩ to 20 kΩ at the time of the room temperature shown in the lamp impedance characteristics Y1*a*. Moreover, at the time of the low temperature shown in the lamp impedance characteristics Y1*b*, the lamp impedance further increases, and for example, increases to approximately 20 kΩ to 40 kΩ when the ambient temperature is 0° C. This matter has been a cause of a phenomenon that the light output of the fluorescent lamp FL is lowered at the time of the low temperature to thereby result in that the flicker and the fading become prone to occur.

The discharge lamp lighting device according to the first embodiment includes the direct current superimposing circuit 1 that superimposes the micro direct current voltage component on the fluorescent lamp FL. At around the rating lighting (Full) in which the lamp impedance is low, the direct current voltage component is hardly generated on both ends of the fluorescent lamp FL; however, at the dimming time when the lamp impedance is high, the direct current voltage component is generated on both ends of the fluorescent lamp FL.

Figure 3:
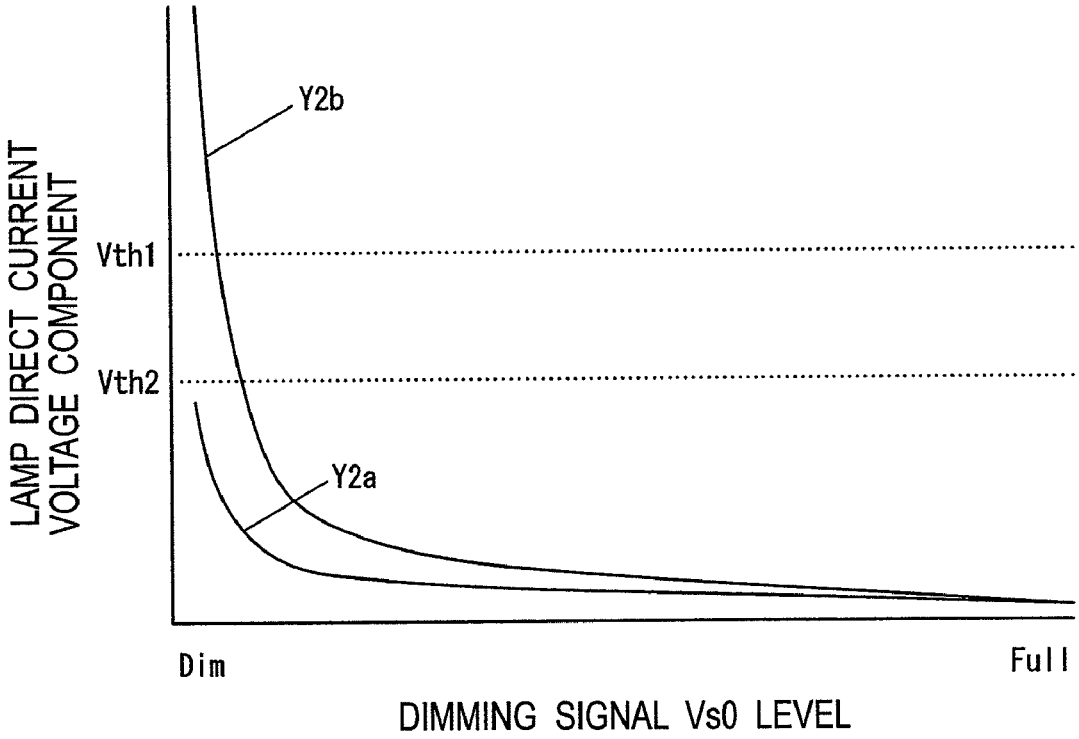
FIG. 3 is a chart showing operations of the same discharge lamp light device as above.

The direct current voltage component (lamp voltage direct current component) generated on both ends of the fluorescent lamp FL by the direct current superimposing circuit 1 is determined by the direct current voltage Vdc of the direct current voltage source E1 and a voltage division ratio by resistance values of the resistors R11, R12 and R13 and the lamp impedance. Therefore, as shown in FIG. 3, the direct current voltage component generated on both ends of the fluorescent lamp FL increases in proportion to the increase of the lamp impedance. Specifically, the direct current voltage component is lowered in the case where the level of the dimming signal Vs0 is at around the rating lighting (Full), and radically increases in the case where the level of the dimming signal Vs0 is at around the dimming lower limit (Dim). Note that, in FIG. 3, characteristics Y2*a* represent a change of the direct current voltage component at the time of the room temperature, and characteristics Y2*b* represent a change of the direct current voltage component at the low temperature.

As shown in FIG. 3, the correction unit 3 compares the direct current voltage component detected by the direct current voltage detection circuit 2 and the first threshold value Vth1, and in the case where the direct current voltage component is larger than the threshold value Vth1, gradually increases the level of the dimming signal Vs2 outputted therefrom. Moreover, the OR circuit unit 4 compares the level of the dimming signal Vs1 inputted thereto from the outside and the level of the dimming signal Vs2 outputted from the correction unit 3 with each other, and outputs the dimming signal Vs0 set at a higher one between the levels. Hence, in the case where the level of the dimming signal Vs1 from the outside is set low and the ambient temperature is low, the direct current voltage component becomes larger than the threshold value Vth1, and accordingly, the level of the dimming signal Vs2 increases to become larger than the dimming signal Vs1, and the OR circuit unit 4 outputs the dimming signal Vs0 with the same level as that of the dimming signal Vs2.

Then, the dimming command value control circuit 5 outputs a dimming command value voltage Va1 based on the dimming signal Vs0 corrected in a direction where the level increases more than usual, and the operational amplifier OP1 compares the dimming command value Va1 and the both-end voltage of the resistor R1, which is equivalent to the output power of the inverter circuit INV, with each other, and changes the output voltage of the operational amplifier OP1 itself, which represents a difference therebetween.

The output terminal of the operational amplifier OP1 is connected to the inverter control circuit 6. The inverter control circuit 6 changes the switching frequencies of the switching elements Q1 and Q2 in response to the output voltage of the operational amplifier OP1. In such a way, the output power of the inverter circuit INV is controlled by the inverter control circuit 6. As described above, the discharge lamp lighting device performs feedback control so that the both-end voltage of the resistor R1, which is equivalent to the output power of the inverter circuit INV, can become substantially the same as the dimming command value voltage Va1. Moreover, the dimming command value control circuit 5 appropriately changes the dimming command value voltage Va1 in response to the level of the dimming signal Vs0, thereby adjusts the output power of the inverter circuit INV in response to the dimming signal Vs0, and dims the fluorescent lamp FL. Specifically, the dimming command value control circuit 5, the operational amplifier OP1, the resistor R2, the capacitor C6, and the inverter control circuit 6 compose a control circuit that dims the fluorescent lamp FL by increasing or decreasing the amount of alternating current power, which the inverter circuit INV supplies to the fluorescent lamp FL, in response to the fluctuations of the level of the dimming signal Vs2.

Hence, in the case where the ambient temperature is low in a state where the level of the dimming signal Vs1 from the outside is low, the light output of the fluorescent lamp FL has been heretofore lowered, which has resulted in the occurrences of the flicker and the fading. However, the discharge lamp lighting device of the first embodiment allows the correction unit 3 to preferentially output the dimming signal Vs2 higher in level than the original dimming signal Vs1, and operates to automatically increase the level of the dimming signal Vs0 to the same level as that of the dimming signal Vs2 so that the decrease of the light output at the time of the low temperature can be corrected. In such a way, the discharge lamp lighting device can prevent the occurrences of the flicker and fading of the fluorescent lamp FL.

The operations of increasing the level of the dimming signal Vs2, which are performed by the correction unit 3, are continued until the direct current voltage component detected by the direct current voltage detection circuit 2 falls down below the first threshold value Vth1, and accordingly, an excessive decrease of the light output can be prevented.

Moreover, in the case where the lamp impedance is lowered owing to the increase of the ambient temperature and the increase of the level of the dimming signal Vs1, and the direct current voltage component detected by the direct current voltage detection circuit 2 falls down below the second threshold value Vth2, the correction unit 3 gradually lowers the dimming signal Vs2. Then, when the level of the dimming signal Vs2 falls down below the level of the dimming signal Vs1, the OR circuit unit 4 outputs the dimming signal Vs0 with the same level as that of the dimming signal Vs1. Specifically, the discharge lamp lighting device allows the OR circuit unit 4 to preferentially output the original dimming signal Vs1, and the usual dimming control is performed in accordance with the dimming signal Vs1.

Note that the above-described first threshold value Vth1 and second threshold value Vth2 are set so as to satisfy the relationship of Vth1≧Vth2, and a difference between the first threshold value Vth1 and the second threshold value Vth2 just needs to be appropriately set, for example, in consideration for transient operations in such a case where the dimming signal is radically changed.

Moreover, in the OR circuit unit 4, it is desirable that a time constant at which the level of the dimming signal Vs0 is changed be set larger than a time constant at which the level of the dimming signal Vs1 from the outside is changed, and be set smaller than a response time constant of the direct current voltage detection circuit 2. In such a way, for example, even in the case where the level of the dimming signal Vs1 inputted from the outside is radically changed, the discharge lamp lighting device can stabilize a transient change of the dimming signal Vs0 outputted from the dimming signal correction circuit K1, and can stabilize the transient operations of the dimming signal correction circuit K1.

As described above, the direct current voltage component superimposed on the high-frequency voltage on both ends of the fluorescent lamp FL is detected, whereby the lamp impedance is equivalently detected. Moreover, the level of the dimming signal Vs0 is automatically increased and decreased in response to the detection value of this lamp impedance, whereby the flicker and the fading, which are caused by the decrease of the light output, are prevented from occurring, and stability of the fluorescent lamp FL at the time of dimming lighting is enhanced.

Moreover, in the discharge lamp lighting device of the first embodiment, such a setting is made so that the direct current voltage component detected by the direct current voltage detection circuit 2 can exceed the first threshold value Vth1 when the ambient temperature is low (refer to FIG. 3); however, the setting may be made so that the direct current voltage component can exceed the first threshold value Vth1 also at the time of the room temperature.

Note that the circuit configuration of the discharge lamp lighting device, which is shown in FIG. 1, is an example, and the respective configurations of the inverter circuit INV, the resonance circuit, the filament preheating circuit and the feedback control circuit are not limited to the configurations shown in FIG. 1, and just need to include the respective functions described in the first embodiment.

Second Embodiment

Figure 4:
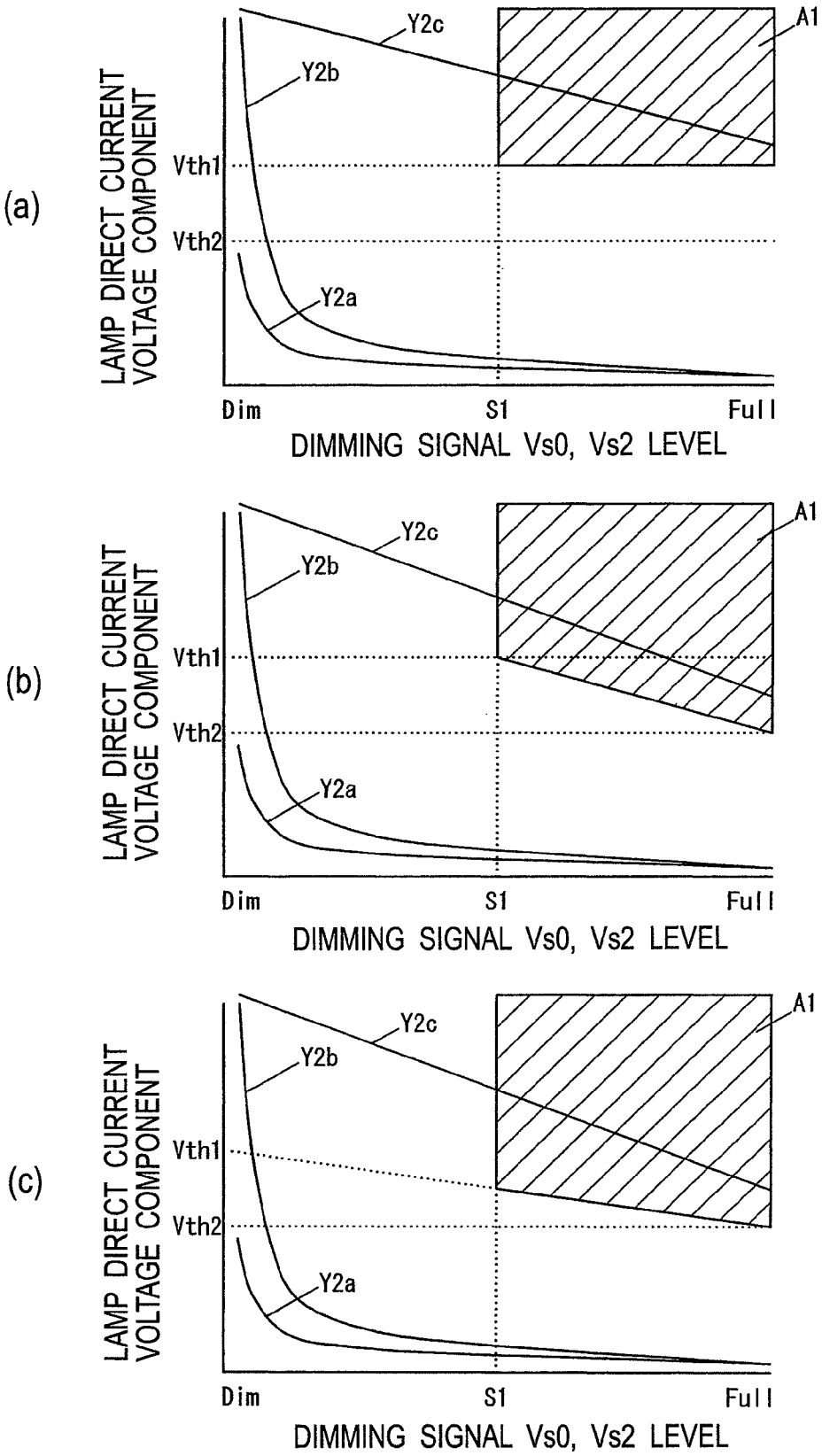
FIG. 4 is a chart showing operations of a discharge lamp lighting device of a second embodiment (a)-(c).

A discharge lamp lighting device of a second embodiment is one in which a function to detect a lifetime end state of the fluorescent lamp FL (discharge lamp) is added to the configuration of the discharge lamp lighting device according to the first embodiment. Operations of this discharge lamp lighting device are shown in FIG. 4A, FIG. 4B and FIG. 4C. Note that a circuit configuration of the discharge lamp lighting device according to the second embodiment is shown in FIG. 1 in a similar way to the discharge lamp lighting device according to the first embodiment, the same reference numerals are assigned to similar constituents, and a description thereof will be omitted.

In general, when the lifetime of the discharge lamp is at the end thereof, a rectification function (asymmetry of lamp current owing to half-wave discharge) of the discharge lamp occurs, and the direct current voltage component of the both-end voltage of the discharge lamp increases. However, in the low-luminous-flux dimming range where the lamp current is lowered, the rectification function (asymmetry of lamp current owing to half-wave discharge) of the discharge lamp is weak also in the lifetime end of the discharge lamp, and a sufficient direct current voltage component is not generated on both ends of the discharge lamp, and accordingly, it has been heretofore difficult to detect the lifetime end state of the discharge lamp.

Meanwhile, in the discharge lamp lighting device according to the second embodiment, as shown in FIG. 1, the direct current superimposing circuit 1 that superimposes the micro direct current voltage component on the fluorescent lamp FL is provided, and accordingly, it is possible to detect the increase of the lamp impedance at the time of the lifetime end of the fluorescent lamp FL. Then, when the fluorescent lamp FL turns to the lifetime end state and it becomes difficult to maintain the discharge at the dimming time when the brightness of the fluorescent lamp FL is controlled, the lamp impedance increases more than usual, and accordingly, the direct current voltage component generated on both ends of the fluorescent lamp FL by the direct current superimposing circuit 1 also increases. Then, as described in the first embodiment, the direct current voltage detection circuit 2 detects the value of this direct current voltage component, and in the case where the detection value of the direct current voltage component exceeds the first threshold value Vth1, the level of the dimming signal Vs0 outputted by the dimming signal correction circuit K1 is corrected in the direction of increase thereof. If the fluorescent lamp FL is normal, then the direct current voltage component decreases by the increase of the level of the dimming signal Vs0, and at the point of time when the direct current voltage component falls down below the first threshold value Vth1, the correction operations for the dimming signal are completed.

However, in the case where the fluorescent lamp FL is in the lifetime end state, when the level of the dimming signal Vs0 increases, the rectification function of the fluorescent lamp FL owing to the half-wave discharge intensifies. Accordingly, as shown by characteristics Y2*c* in FIG. 4A, the direct current voltage component on both ends of the fluorescent lamp FL in the lifetime end state exceeds the first threshold value Vth1 over the entire dimming range.

In this connection, in the case where the direct current voltage component on both ends of the fluorescent lamp FL exceeds the first threshold value Vth1 at the point of time when the level of the dimming signal Vs2 increases to a predetermined level S1 by the correction operations (at this time, the dimming signal Vs0 outputted by the OR circuit unit 4 is at the same level as that of the dimming signal Vs2) after the detection value of the direct current voltage component exceeds the first threshold value Vth1, a correction unit 3 of the discharge lamp lighting device according to the second embodiment recognizes that the fluorescent lamp FL is at the lifetime end (refer to FIG. 4A), outputs an oscillation stop signal Vr1 from the correction unit 3 to the inverter control circuit 6, and stops the switching operations of the switching elements Q1 and Q2, thereby prevents excessive stresses to the fluorescent lamp FL and the circuit parts from occurring at the time of the lifetime end. Specifically, in FIG. 4A, a region where the dimming signal Vs2 is equal to or more than the level S1 and the lamp voltage direct current component is equal to or more than the first threshold value Vth1 becomes a lamp voltage end detection region A1.

Moreover, as shown in FIG. 4B, it is desirable to adopt a configuration so that, in a region where the dimming signal Vs2 is equal to or more than the level S1, the first threshold value Vth1 can be linearly lowered as the level of the dimming signal Vs2 increases. Alternatively, as shown in FIG. 4C, it is desirable to adopt a configuration so that, over the entire dimming range, the first threshold value Vth1 can be linearly lowered as the level of the dimming signal Vs2 increases. The discharge lamp lighting device as described above can set the first threshold value Vth1 at the optimum value corresponding to the level of the dimming signal Vs2, and can enhance the detection accuracy for the lifetime end state of the fluorescent lamp FL. Note that such a pattern of varying the first threshold value Vth1 may be either continuous or step-by-step.

Moreover, the correction operations for the dimming signal may be performed while the second threshold value Vth2 is also being made variable in response to the level of the dimming signal Vs2.

Third Embodiment

Figure 5:
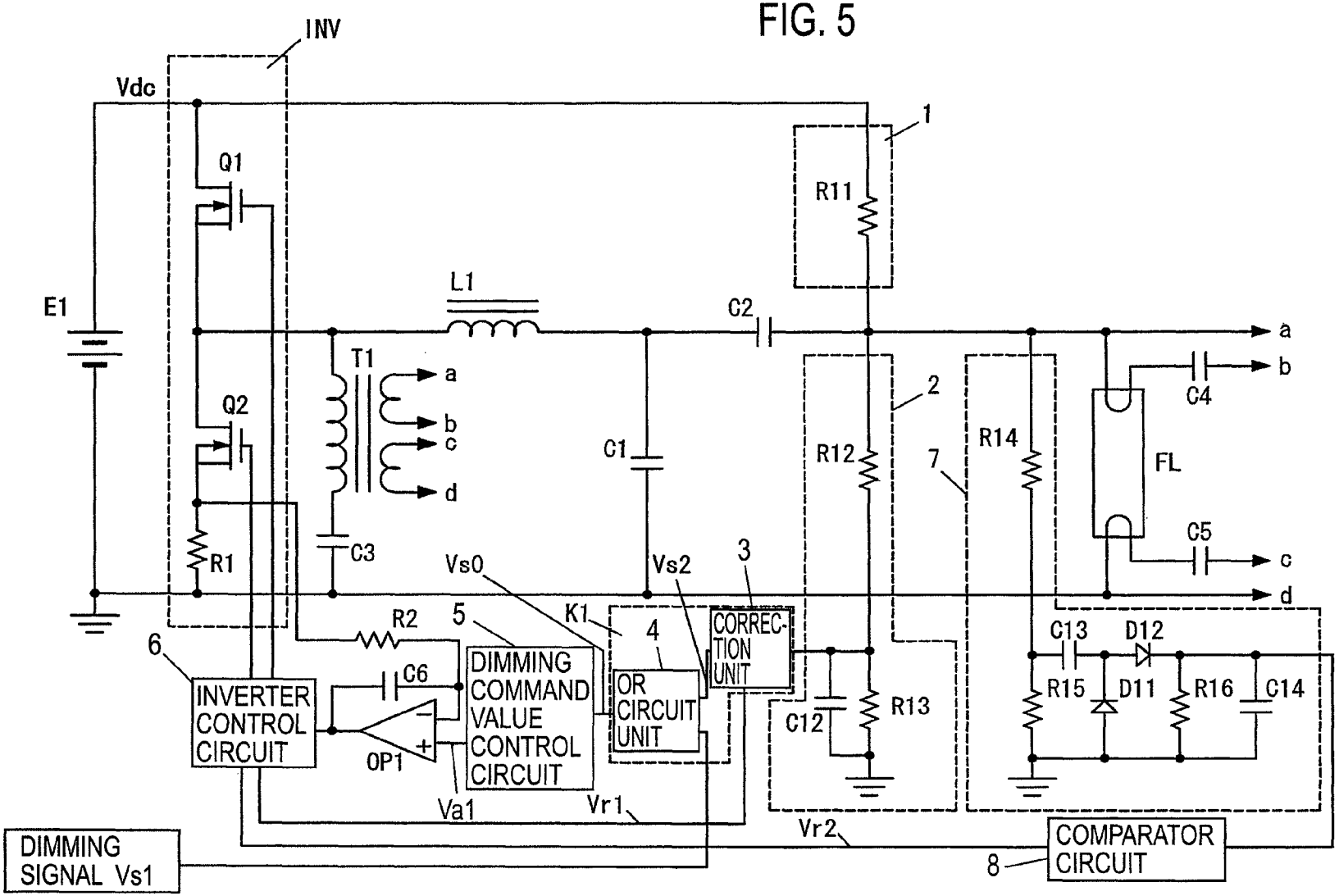
FIG. 5 is a diagram showing a circuit configuration of a discharge lamp lighting device of a third embodiment.

FIG. 5 is a circuit diagram showing a configuration of a discharge lamp lighting device of this embodiment, in which, to the configuration of the first embodiment, there are added: an alternating current voltage detection circuit 7 that detects the alternating current voltage component on both ends of the fluorescent lamp FL; and a comparator circuit 8 that compares a detection value of the alternating current voltage detection circuit 7 with a third threshold value Vth3, and based on a result of such comparison concerned, outputs, to the inverter control circuit 6, an oscillation stop signal Vr2 for stopping the switching operations of the switching elements Q1 and Q2. Note that the same reference numerals are assigned to similar constituents to those of the first embodiment, and a description thereof will be omitted.

The alternating current voltage detection circuit 7 is composed of: a series circuit of resistors R14 and R15 connected between one end of the fluorescent lamp FL and the low-voltage-side output (ground level) of the direct current voltage source E1; a series circuit of a capacitor C13 and a diode D11, which is connected in parallel to the resistor R15; a series circuit of a diode D12 and a resistor R16, which is connected in parallel to the diode D11; and a capacitor C14 connected in parallel to the resistor R16. Then, the voltage generated on both ends of the fluorescent lamp FL is subjected to the voltage division by the resistors R14 and R15, the voltage subjected to the voltage division is rectified by the diodes D11 and D12 after the direct current voltage component is removed therefrom by the capacitor C13, and the rectified voltage is smoothed by the resistors R16 and the capacitor C14. In such a way, the alternating current voltage component on both ends of the fluorescent lamp FL is detected as a direct current voltage value.

Figure 6:
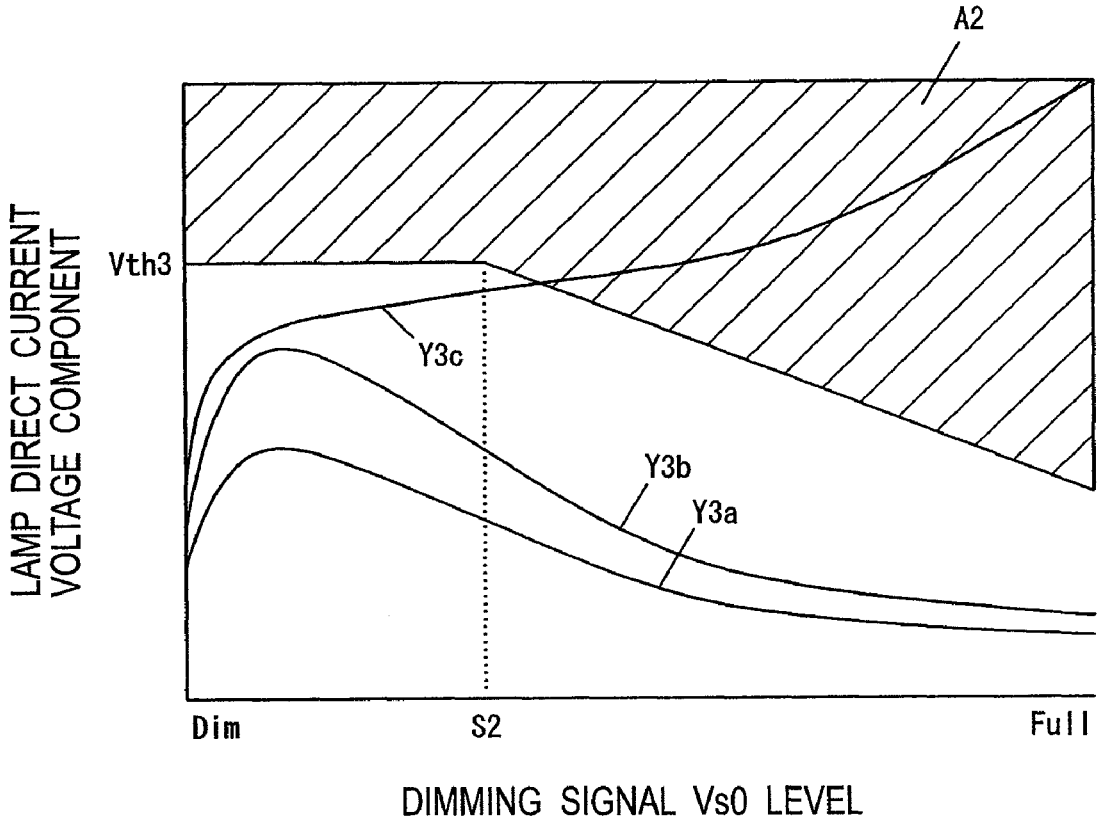
FIG. 6 is a chart showing operations of the same discharge lamp lighting device as above.

Here, FIG. 6 illustrates changes of the alternating current voltage component (lamp voltage alternating current component) on both ends of the fluorescent lamp FL, which follow the dimming. Characteristics Y3*a* show a change of the alternating current voltage component (lamp voltage alternating current component) on both ends of the fluorescent lamp FL at the time of the room temperature, characteristics Y3*b* show a change of the alternating current voltage component (lamp voltage alternating current component) on both ends of the fluorescent lamp FL at the time of the low temperature, and characteristics Y3*c* show a change of the alternating current voltage component (lamp voltage alternating current component) on both ends of the fluorescent lamp FL at the time when the lamp is abnormal. In the case of using the normal lamp, at both of the time of the room temperature and the time of the low temperature, as the dimming signal Vs0 increases from the dimming lower limit (Dim), the alternating current voltage component also increases, and thereafter, the alternating current voltage component is gradually lowered as the dimming signal Vs0 increases. The alternating current voltage component has such characteristics (refer to characteristics Y3*a* and Y3*b*).

In such an abnormal state that the filaments on both ends of the fluorescent lamp FL waste in the lifetime end of the fluorescent lamp FL, the discharge generated therefrom becomes difficult, and the lamp impedance increases. However, the rectification function (asymmetry of lamp current owing to half-wave discharge) of the fluorescent lamp FL does not occur, and in the conventional configuration shown in FIG. 11, the direct current voltage component on both ends of the fluorescent lamp FL does not increase. However, the alternating current voltage component generated on both ends of the fluorescent lamp FL increases owing to a resonance function between the inductor L1 and the capacitor C1. In usual, this alternating current voltage component is detected, whereby the abnormal state of the fluorescent lamp FL can be detected. However, for example, in such a low-luminous-flux dimming range that the dimming ratio is 10% or less, the resonance function is weak, and accordingly, the alternating current voltage component does not increase sufficiently even if the lamp impedance increases, and it has been difficult to detect the abnormal state of the fluorescent lamp FL.

However, the discharge lamp lighting device according to the third embodiment superimposes the micro direct current voltage component on both ends of the fluorescent lamp FL by the direct current superimposing circuit 1, and accordingly, can detect the increase of the lamp impedance by detecting the direct current voltage component superimposed on the high-frequency voltage on both ends of the fluorescent lamp FL. Hence, when the fluorescent lamp FL turns to the lifetime end state, and comes to have difficulty maintaining the discharge, the lamp impedance increases, and the direct current voltage component on both ends of the fluorescent lamp FL increases, then the discharge lamp lighting device detects this increase of the direct current voltage component by the direct current voltage detection circuit 2, and in the case where the detected direct current voltage component exceeds the first threshold value Vth1, corrects the dimming signal Vs0 in the direction of increasing the level thereof by the dimming signal correction circuit K1. Hence, the discharge lamp lighting device increases the output of the inverter circuit INV as the dimming signal Vs0 increases, intensifies the resonance function between the inductor L1 and the capacitor C1, and increases the alternating current voltage component generated on both ends of the fluorescent lamp FL.

Then, the comparator circuit 8 compares the alternating current voltage component, which is detected by the alternating current voltage detection circuit 7, with the third threshold value Vth3, and in the case where the alternating current voltage component exceeds the third threshold value Vth3, recognizes that the fluorescent lamp FL is in the abnormal state, and outputs the oscillation stop signal Vr2 to the inverter control circuit 6. Then, the inverter control circuit 6 stops the switching operations of the switching elements Q1 and Q2, and thereby prevents the excessive stresses to the fluorescent lamp FL and the circuit parts from occurring owing to such abnormality of the lamp. Specifically, a region in FIG. 6, where the lamp voltage alternating current component is equal to or more than the third threshold value Vth3, becomes a lamp abnormality detection region A2.

Moreover, as shown in FIG. 6, a configuration is adopted so that the third threshold value Vth3 can be lowered as the level of the dimming signal Vs0 increases in a region where the level of the dimming signal Vs0 is equal to or more than a level S2, whereby the third threshold value Vth3 can be set at the optimum value corresponding to the level of the dimming signal Vs0, detection accuracy of such a lamp abnormal state can be enhanced, and it becomes possible to prevent erroneous detection of the normal lamp. Note that the third threshold value Vth3 just needs to be changed continuously or step by step.

As described above, the discharge lamp lighting device according to the third embodiment uses the correction operations for the dimming signal, which are described in the first embodiment and are performed by detecting the direct current voltage component on both ends of the fluorescent lamp FL, and uses such detection operations for the alternating current voltage component on both ends of the fluorescent lamp FL, the detection operations being described above, thus making it possible to detect the abnormal state of the fluorescent lamp FL in the low-luminous-flux dimming state, in which such detection has been heretofore difficult.

Fourth Embodiment

Figure 7:
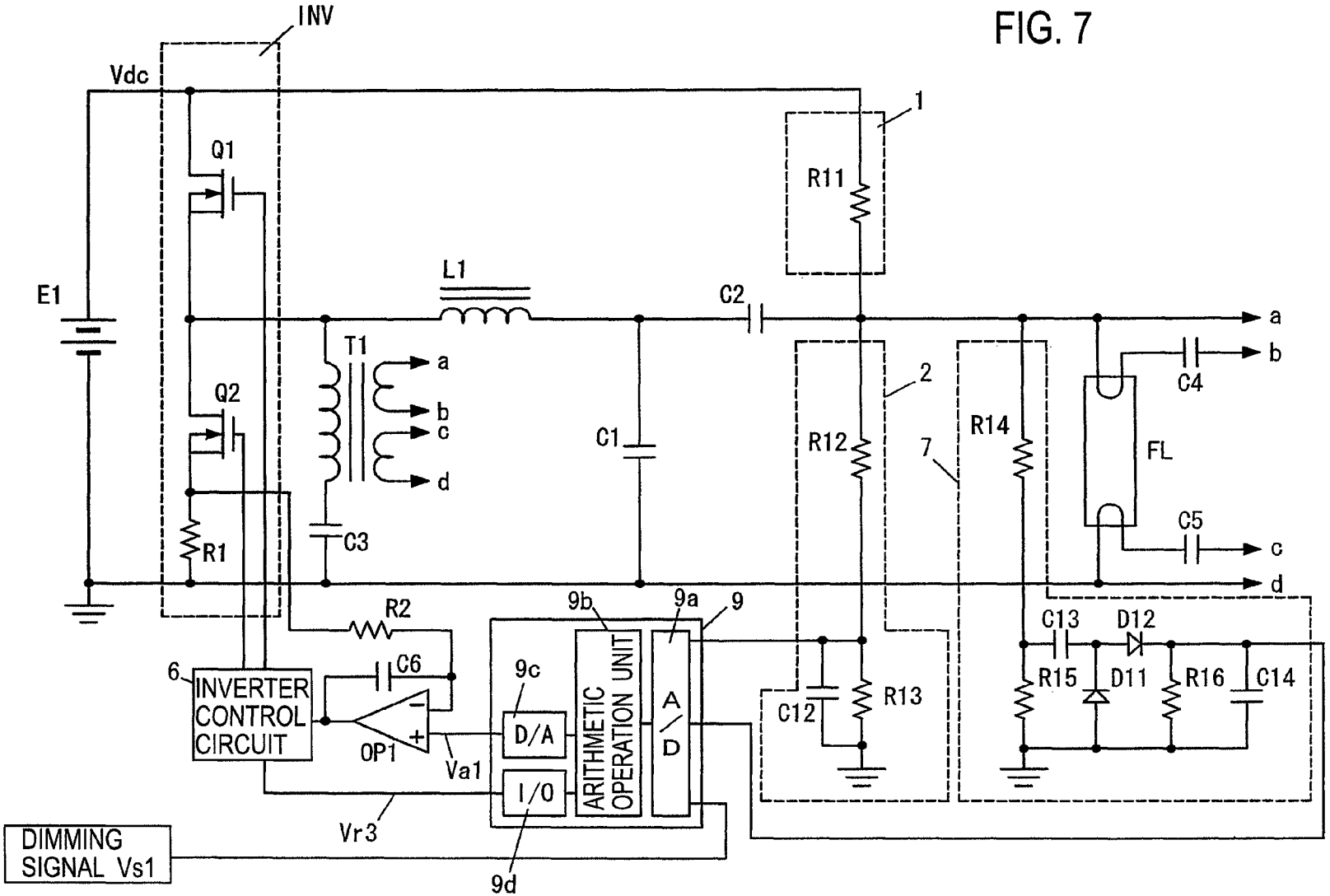
FIG. 7 is a diagram showing a circuit configuration of a discharge lamp lighting device of a fourth embodiment.

FIG. 7 is a circuit diagram showing a configuration of a discharge lamp lighting device according to a fourth embodiment, in which the dimming signal correction circuit K1, the dimming command value control circuit 5 and the comparator circuit 8 in the configuration of the third embodiment are composed of a microcomputer 9.

The microcomputer 9 includes: an A/D converter 9*a* that composes an input port; an arithmetic operation unit 9*b* that executes programs, thereby functions as the dimming signal correction circuit K1, the dimming command value control circuit 5 and the comparator circuit 8; a D/A converter 9*c* that composes an output port; and a digital port 9*d*. Then, the direct current voltage component on both ends of the fluorescent lamp FL, which is detected by the direct current voltage detection circuit 2, the alternating current voltage component on both ends of the fluorescent lamp FL, which is detected by the alternating current voltage detection circuit 7, and the dimming signal Vs1 from the outside, are inputted to the A/D converter 9*a*, and are converted into digital signals. The direct current voltage component on both ends of the fluorescent lamp FL, which is converted into the digital signal, is subjected to processings by the arithmetic operation unit 9*b*, which are similar to those by the dimming control/correction circuit K1 and dimming command value control circuit 5 of the first embodiment. Specifically, the direct current voltage component is compared with the first threshold value Vth1, and in the case where the direct current voltage component is larger than the threshold value Vth1, the level of the dimming signal Vs2 is gradually increased. Then, the level of the dimming signal Vs1 inputted from the outside and the level of the dimming signal Vs2 are compared with each other, the dimming signal Vs0 set at a higher one between the levels is created, and the dimming command value voltage Va1 corresponding to the level of this dimming signal Vs0 is outputted through the D/A converter 9*c*, whereby the switching operations of the switching elements Q1 and Q2 are controlled through the operational amplifier OP1 and the inverter control circuit 6, and the dimming control is performed for the fluorescent lamp FL.

Moreover, in a similar way to the second embodiment and the third embodiment, the arithmetic operation unit 9 executes, by the programs, the functions to detect the lifetime end state and lamp abnormal state of the fluorescent lamp FL, and in the case of having detected the lifetime end state and lamp abnormal state of the fluorescent lamp FL, outputs the oscillation stop signal Vr3 to the inverter control circuit 6 through the digital port 9*d*, and stops the switching operations of the switching elements Q1 and Q2. In such a way, the excessive stresses to the fluorescent lamp FL and the circuit parts are prevented from occurring at the time of the lifetime end and owing to the abnormality of the lamp.

Furthermore, the variable controls for the threshold values Vth1, Vth2 and Vth3, which are described in the first embodiment to the third embodiment, can also be realized by executing the programs in the arithmetic operation unit 9.

As described above, the discharge lamp lighting device according to the fourth embodiment can realize complicated functions such as the correction function and the comparison function for the dimming signals and the variable function for the threshold values by using the relatively inexpensive microcomputer 9. Accordingly, it becomes possible to reduce cost and to reduce a packaging space. Moreover, even in the case where a type of the discharge lamp to be lighted differs, it becomes possible to change the respective threshold values and the like by changing the programs, and a design change can be performed easily.

Fifth Embodiment

Figure 8:
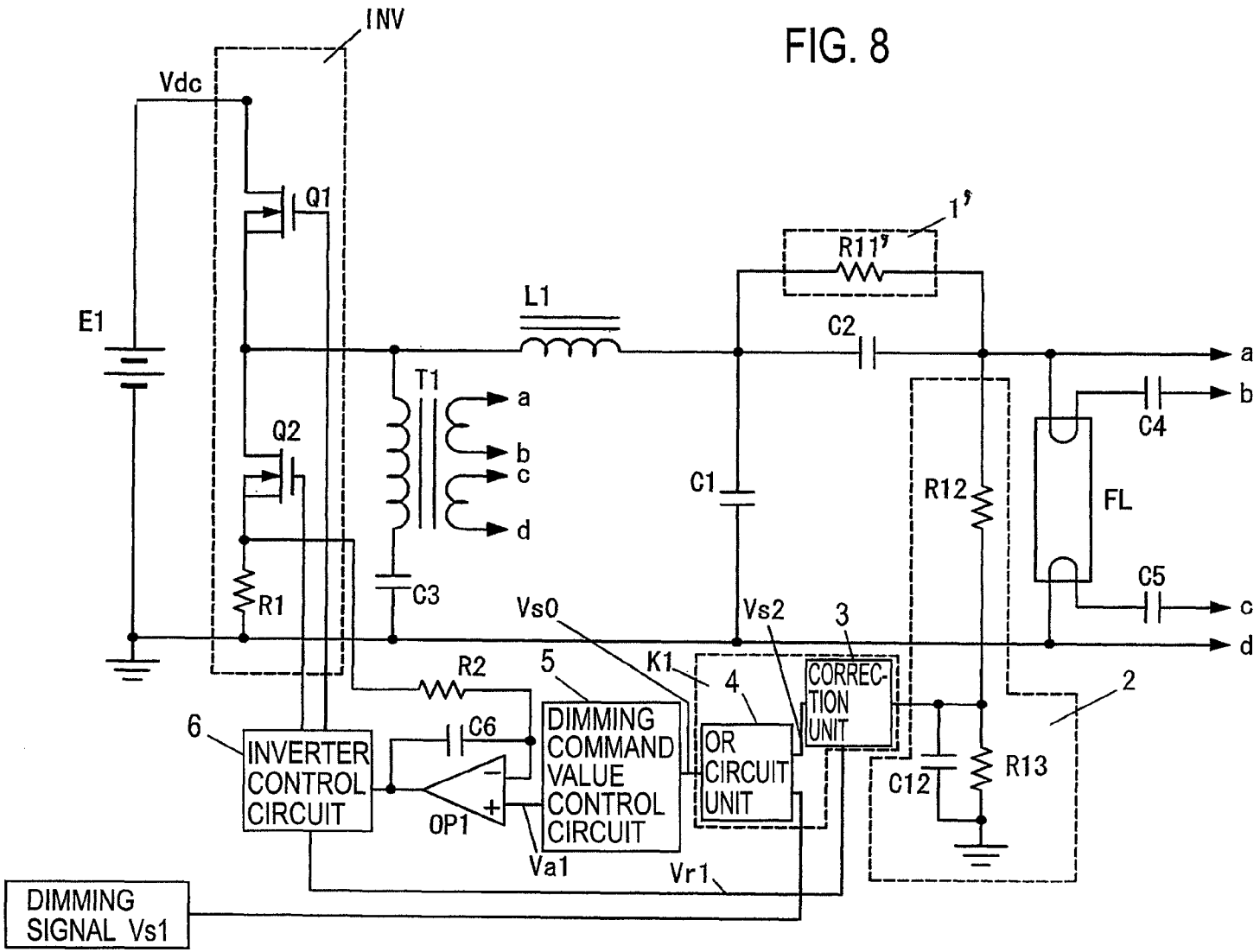
FIG. 8 is a diagram showing a circuit configuration of a discharge lamp lighting device of a fifth embodiment.

FIG. 8 is a circuit diagram showing a configuration of a discharge lamp lighting device according to a fifth embodiment. The fifth embodiment is different from the first embodiment in that the direct current superimposing circuit 1 is composed by connecting a resistor R11' serving as an impedance element in parallel to the capacitor C2 composing such a resonance system. The direct current superimposing circuit 1' superimposes the direct current voltage component, which is contained in the output voltage of the inverter circuit INV, on the fluorescent lamp FL through the resistor R11'. Note that the same reference numerals are assigned to similar constituents to those of the first embodiment, and a description thereof will be omitted.

Moreover, the direct current superimposing circuit just needs to be one in which the discharge lamp is connected through the impedance element to both ends of a direct current power supply or a power supply including the direct current voltage component, and is not limited to the configurations of the direct current superimposing circuits 1 of the first embodiment to the fourth embodiment or to the configuration of the direct current superimposing circuit 1' of the fifth embodiment.

Sixth Embodiment

Figure 9:
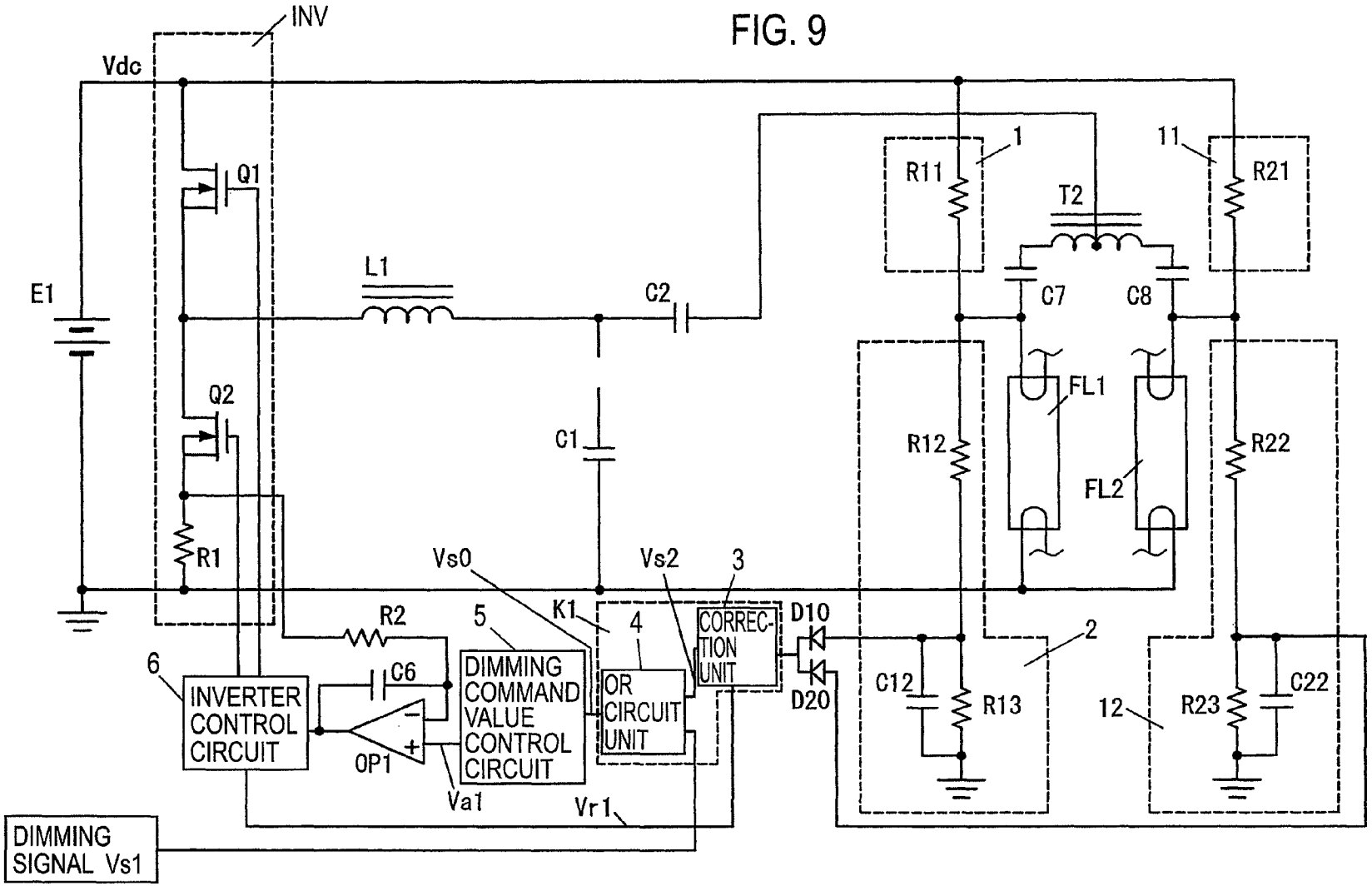
FIG. 9 is a diagram showing a circuit configuration of a discharge lamp lighting device of a sixth embodiment.

FIG. 9 is a circuit diagram showing a configuration of a discharge lamp lighting device of this embodiment. The discharge lamp lighting device is one for multiple lamps, which enables lighting and dimming of a plurality of fluorescent lamps FL1 and FL2 in the configuration of the first embodiment. Note that the same reference numerals are assigned to similar constituents to those of the first embodiment, and a description thereof will be omitted.

In the discharge lamp lighting device according to the sixth embodiment, between the capacitor C2 composing the resonance system and the fluorescent lamps FL1 and FL2, there is provided a balancer T2 for uniformly flowing lamp currents, which are to flow through the respective fluorescent lamps, through two channels thereof. Output ends of the respective channels of this balancer T2 are connected to the fluorescent lamps FL1 and FL2 through capacitors C7 and C8, respectively.

Moreover, to the fluorescent lamp FL1, there are connected: the direct current superimposing circuit 1 that connects the high-voltage-side output of the direct current voltage source E1 through the resistor R11 serving as the impedance element to a node between the fluorescent lamp FL1 and the capacitor C7; and the direct current voltage detection circuit 2 composed of the resistors R12 and R13 and the capacitor C12. To the fluorescent lamp FL2, there are connected: a direct current superimposing circuit 11 composed in a similar way to the direct current superimposing circuit 1 by using a resistor R21; and a direct current voltage detection circuit 12 composed in a similar way to the direct current voltage detection circuit 2 by using resistors R22 and R23 and a capacitor C22. Here, the capacitors C7 and C8 are ones for cutting direct current voltage components, and prevent the direct current voltage components, which are generated in the respective fluorescent lamps, from affecting each other.

Moreover, the respective direct current voltage components on both ends of the fluorescent lamps FL1 and FL2, which are detected by the direct current voltage detection circuits 2 and 12, are inputted to the correction unit 3 through diodes D10 and D20, and the correction unit 3 corrects the dimming signal level based on the direct current voltage component higher in voltage level between the respective direct current voltage components of the fluorescent lamps FL1 and FL2.

Hence, in accordance with this discharge lamp lighting device, even if a difference occurs between the respective light outputs of the fluorescent lamps FL1 and FL2 owing to the variations of the circuit parts and the fluorescent lamps, the level of the dimming signal is corrected in response to a state of the fluorescent lamp FL of which direct current voltage component is larger, that is, to a state of the fluorescent lamp FL of which light output is lower. Accordingly, one of the fluorescent lamps FL is prevented from causing the flicker and the fading as a result of that the light output thereof is lowered to an extreme.

Moreover, in accordance with the discharge lamp lighting device, even in the case where one of the fluorescent lamps FL turns to the lifetime end state or the lamp abnormal state, and the direct current voltage component increases therein, the lifetime end state or the lamp abnormal state can be surely detected, and the switching operation of the inverter circuit INV can be stopped.

Note that, in FIG. 9, the filament preheating circuit for the fluorescent lamps FL and the alternating current voltage detection circuit 7 are omitted; however, these are provided as in the first embodiment to the fifth embodiment, whereby similar functions to those therein can be provided.

Seventh Embodiment

Figure 10:
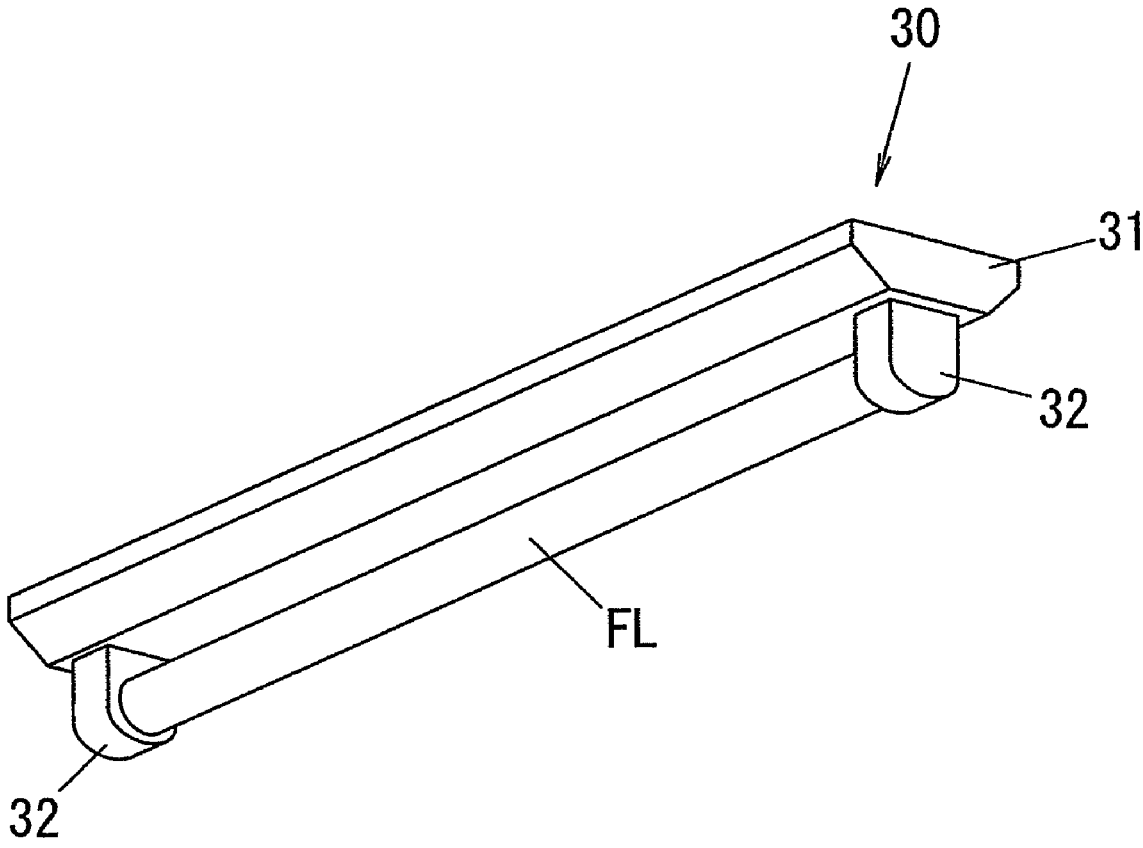
FIG. 10 is a view showing an exterior appearance of an illuminating device of a seventh embodiment.

FIG. 10 is a perspective view showing an exterior appearance of an illuminating device 30 that mounts thereon the discharge lamp lighting device of any of the first embodiment to the sixth embodiment. This illuminating device 30 includes: a housing 31 that houses the discharge lamp lighting device of any of the first embodiment to the sixth embodiment; and sockets 32 for connecting the fluorescent lamp FL to the discharge lamp lighting device. Then, also in the illuminating device 30 of this embodiment, in the case of being used in a state where the ambient temperature is low, the illuminating device 30 can prevent the occurrences of the extreme decrease, flicker and fading of the light output.

INDUSTRIAL APPLICABILITY

In accordance with the present invention, even in the case where the light output is lowered, the stability of the discharge lamp at the time of the dimming lighting can be enhanced.

The invention claimed is:

1. A discharge lamp lighting device that dims a discharge lamp by increasing or decreasing an amount of supplied power to the discharge lamp in response to fluctuations of a level of a dimming signal, comprising:

an alternating current output circuit that supplies alternating current power to the discharge lamp;

a direct current superimposing circuit that superimposes a direct current voltage on an alternating current voltage applied to the discharge lamp;

a direct current voltage detection circuit that detects a direct current voltage component of a voltage generated on both ends of the discharge lamp;

a dimming signal correction circuit that receives a detection value of the direct current voltage detection circuit and a dimming signal that is from an outside, outputs a dimming signal higher in level than the inputted dimming signal in a case where the detection value of the direct current voltage detection circuit exceeds a first threshold value, and decreases the level of the outputted dimming signal to the level of the inputted dimming signal in a case where the detection value of the direct current voltage detection circuit falls down below a second threshold value that is equal to or less than the first threshold value; and a control circuit that dims the discharge lamp by increasing or decreasing an amount of the alternating current power in response to fluctuations of the level of the dimming signal outputted by the dimming signal correction circuit, the alternating current power being supplied to the discharge lamp by the alternating current output circuit.

2. The discharge lamp lighting device according to claim 1, wherein the dimming signal correction circuit includes:

correction means for creating a dimming signal of which level increases in the case where the detection value of the direct current voltage detection circuit exceeds the first threshold value, and decreases in the case where the detection value of the direct current voltage detection circuit falls down below the second threshold value; and higher value prioritizing means for comparing the level of the dimming signal inputted from the outside and the level of the dimming signal outputted from the correcting means with each other, and outputting the dimming signal set at a higher one between the levels, and the control circuit dims the discharge lamp by increasing or decreasing the amount of alternating current power in response to fluctuations of the level of the dimming signal outputted by the higher value prioritizing means, the alternating current power being supplied to the discharge lamp by the alternating current output circuit.

3. The discharge lamp lighting device according to claim 1, wherein the direct current superimposing circuit is composed in such a manner that the discharge lamp is connected through an impedance element to between both ends of a voltage source containing at least the direct current voltage component.

4. The discharge lamp lighting device according to claim 1, wherein a time constant at which the level of the dimming signal outputted by the dimming signal correction circuit is changed is set larger than a time constant at which the level of the dimming signal inputted to the dimming signal correction circuit is changed, and set smaller than a time constant at which the direct current voltage detection circuit detects the direct current voltage component.

5. The discharge lamp lighting device according to claim 1, further comprising:

means for stopping the supply of the alternating current power from the alternating current output circuit to the discharge lamp in the case where the detection value of the direct current voltage detection circuit exceeds the first threshold value when the dimming signal outputted by the dimming signal correction circuit is at a predetermined level or more.

6. The discharge lamp lighting device according to claim 1, wherein the alternating current output circuit supplies alternating current powers to a plurality of discharge lamps, and includes a plurality of direct current voltage detection circuits which individually detect direct current voltage components of voltages generated on both ends of the respective discharge lamps, and the dimming signal correction circuit corrects the dimming signal in response to a detection value highest in level among detection values of the plurality of direct current voltage detection circuits.

7. The discharge lamp lighting device according to claim 1, wherein a microcomputer is provided, the microcomputer including: an input port to which the detection value of the direct current voltage detection circuit and the dimming signal from the outside are at least inputted; arithmetic operation means for executing a program, thereby outputting the dimming signal higher in level than the inputted dimming signal in the case where the detection value of the direct current voltage detection circuit exceeds the first threshold value, and decreasing the level of the outputted dimming signal to the level of the inputted dimming signal in the case where the detection value of the direct current voltage detection circuit falls down below the second threshold value; and an output port that outputs a dimming command value corresponding to the level of the dimming signal outputted by the arithmetic operation means.

8. An illuminating device, comprising:

a discharge lamp;

the discharge lamp lighting device according to claim 1, the discharge lamp lighting device lighting the discharge lamp;

a housing that houses the discharge lamp lighting device; and sockets which connect the discharge lamp to the discharge lamp lighting device.

9. The discharge lamp lighting device according to claim 1, further comprising:

an alternating current voltage detection circuit that detects an alternating current voltage component of the voltage generated on both ends of the discharge lamp; and means for stopping the supply of the alternating current power from the alternating current output circuit to the discharge lamp in a case where a detection value of the alternating current voltage detection circuit exceeds a third threshold value.

10. The discharge lamp lighting device according to claim 9, wherein at least one threshold value among the first threshold value, the second threshold value and the third threshold value becomes variable in response to the level of the dimming signal.

* * * * *